US011024278B1

(12) United States Patent
Kabakian et al.

(10) Patent No.: US 11,024,278 B1
(45) Date of Patent: Jun. 1, 2021

(54) ACOUSTIC ABSORBER

(71) Applicant: HRL LABORATORIES LLC, Malibu, CA (US)

(72) Inventors: Adour V. Kabakian, Monterey Park, CA (US); Chia-Ming Chang, Agoura Hills, CA (US); John J. Ottusch, Malibu, CA (US); John L. Visher, Malibu, CA (US); Geoffrey P. McKnight, Los Angeles, CA (US)

(73) Assignee: HRL Laboratories, LLC, Malibu, CA (US)

( * ) Notice: Subject to any disclaimer, the term of this patent is extended or adjusted under 35 U.S.C. 154(b) by 158 days.

(21) Appl. No.: 15/177,637

(22) Filed: Jun. 9, 2016

(51) Int. Cl.
*G10K 11/168* (2006.01)

(52) U.S. Cl.
CPC ..... *G10K 11/168* (2013.01)

(58) Field of Classification Search
CPC ..... G10K 11/168
USPC ..... 181/290, 210
See application file for complete search history.

(56) References Cited

U.S. PATENT DOCUMENTS 3,174,580 A * 3/1965 Schulz ..... E04B 1/86 181/290
3,180,448 A * 4/1965 Jones ..... E04B 1/86 181/290
8,714,304 B2 * 5/2014 Kitamura ..... G10K 11/002 181/210
8,893,851 B2 * 11/2014 Kitamura ..... E04B 1/86 181/210
D829,350 S * 9/2018 Elford ..... D25/121
2002/0053484 A1 * 5/2002 Murakami ..... F02B 77/13 181/293
2003/0006092 A1 * 1/2003 D'Antonio ..... E04B 1/86 181/293
2005/0263346 A1 * 12/2005 Nishimura ..... E04B 1/86 181/290
2014/0124288 A1 * 5/2014 Jorgensen ..... E01F 8/0011 181/210
2017/0225764 A1 * 8/2017 Nampy ..... B64C 1/40

OTHER PUBLICATIONS

Wikipedia Entry—Orifice Plate (Year: 2020).*
https://web.archive.org/web/20131204223433/http://www.comsol.com/comsol-multiphysics, 11 pages, Dec. 4, 2013.
Pierce, "Acoustics: An Introduction to Its Physical Principles and Applications," 8 pages, 1989.

* cited by examiner

*Primary Examiner* — Forrest M Phillips
(74) *Attorney, Agent, or Firm* — Lewis Roca Rothgerber Christie, LLP

(57) ABSTRACT

An acoustic absorber is disclosed. The acoustic absorber contains a plurality of adjacent passages defined by walls configured to generate alternating high and low pressure zones as an acoustic energy travels though the acoustic absorber.

24 Claims, 16 Drawing Sheets

ACOUSTIC ABSORBER

FIELD

The present invention relates to an absorber. More particularly, the present invention relates to an acoustic absorber.

BACKGROUND

As known in the art, porous sound absorber materials are commonly placed inside walls to reduce sound transmission or they are placed against solid walls to reduce in-room reflections. They are lightweight, inexpensive, flexible, wide-band, and they dissipate sound as opposed to absorbing it, which reduces the likelihood of exciting various sound radiating vibration modes of host structures. However, they have to cover a significant enough fraction of a wavelength to be effective. While this is not an issue with higher frequencies that have short wavelengths, significant thickness is required for lower frequencies, making them impractical and ineffective as described below with reference to FIG. 1.

As known in the art, acoustic waves are typically described by a combination of pressure and fluid particle velocity fields. Porous type absorbers known in the art act on fluid velocity by converting kinetic energy into heat through viscous dissipation. Referring to FIG. 1, fluid particle velocity represented by dotted line 20 of an acoustic wave is relatively zero adjacent to rigid boundaries like a wall 5 and it increases as the distance from the wall 5 increases until it reaches peak amplitude at a distance of about one quarter wavelength ($\lambda/4$). Thus, a thin porous sound absorber 10, confined to the near-zero velocity region adjacent to the wall 5, is very ineffective because of low fluid velocity in the absorber material. If the thickness of the absorber 10 is increased to extend towards the quarter wavelength peak, where fluid velocities are higher, the sound absorption would increase accordingly. A practical consequence of this phenomenon is that sound dissipation at lower frequencies requires substantial thickness of absorber material, which takes up space and adds weight and cost. For example, at 40 Hz, the wavelength of sound is about 28 feet, so that would require a porous absorber layer to be about 3-4 feet thick to be somewhat effective.

Embodiments presently disclosed address the deficiencies in the known art.

SUMMARY OF THE INVENTION

According to some embodiments, an acoustic absorber is presently disclosed. The acoustic absorber comprising a plurality of adjacent passages defined by walls configured to generate alternating high and low pressure zones as an acoustic energy travels though the acoustic absorber.

According to some embodiments, an acoustic absorber is presently disclosed. The acoustic absorber comprising a plurality of conically shaped through holes configured to generate alternating high and low pressure zones as an acoustic wave travels though the acoustic absorber.

Figure 1:
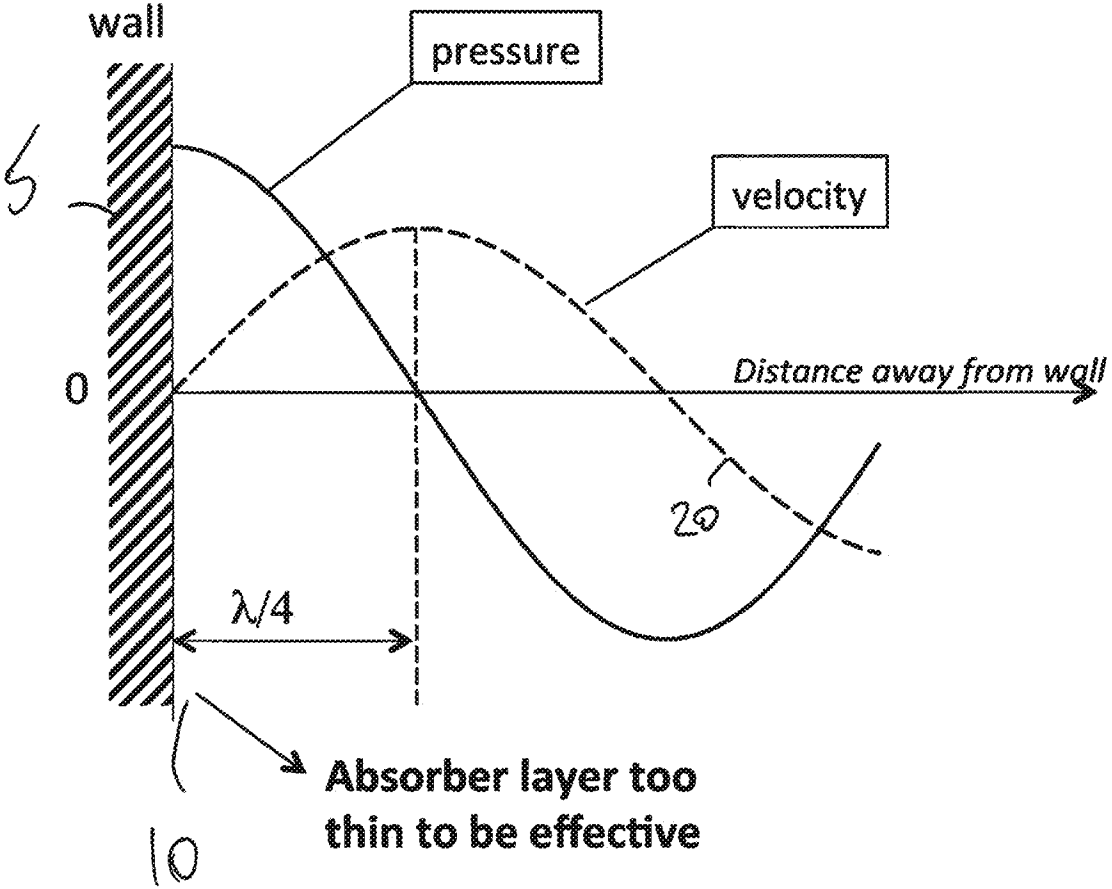
FIG. 1 PRIOR ART
FIG. 1 depicts fluid particle velocity away from a rigid wall as known in the art.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

According to some embodiments, structures presently disclosed are configured to be embedded inside traditional porous type sound absorbers—such as open pore foam, mineral wool, and/or glass fibers—in order to enhance their absorption performance, enabling thin acoustic absorption treatments particularly in the low frequency. In some embodiments, absorption enhancement is obtained by accelerating acoustic "fluid particles", since porous absorbers damp acoustic waves by acting on their "fluid particle" velocity through viscous dissipation. According to some embodiments, structures presently disclosed induce fluid movement within a porous absorber, i.e. wave motion, both in the longitudinal and transverse directions, thereby enhancing absorption over a wide bandwidth of frequencies. In some embodiments, structures presently disclosed produce pressure gradients that induce fluid movement where normally fluid particle velocity is about zero or very low, such as near sound-reflecting rigid surfaces and during the low fluid velocity phase of acoustic waves.

According to some embodiments, structures presently disclosed comprise arrays of alternating converging and diverging nozzles arranged in a plane. In some embodiments, nozzle structures presently disclosed create acoustic pressure gradients, which in turn generate transverse (in-plane) and normal (out-of-plane) fluid particle motion upon which porous absorbers act to dissipate acoustic energy. According to some embodiments, structures presently disclosed create pressure oscillations to induce and enhance fluid particle oscillations.

According to some embodiments, presently disclosed structures improve the performance of porous acoustic absorbers by inducing and increasing fluid movement within them, especially when the noise frequency is very low or when presently disclosed structures are placed in regions where fluid velocity is normally very low or about zero without their presence, such as near reflecting walls and corners.

According to some embodiments, structures presently disclosed are embedded inside porous absorbers, allowing more sound to be dissipated with a given thickness of absorber, or conversely, the same level of dissipation can be achieved with a much thinner layer, thereby minimizing space wasted to sound insulation.

According to some embodiments, porous absorbers enhanced by structures presently disclosed remain effective when placed against sound-reflecting solid walls. According to some embodiments, structure presently disclosed create fluid particle motion near a solid wall where fluid velocity is about zero, permitting the use of thinner absorber layers, thereby minimizing wasted space in rooms and cabins.

According to some embodiments, structures presently disclosed provide sound dissipation enhancement that is effective over a wide spectrum of frequencies. According to some embodiments, structures presently disclosed are stacked inside a bare absorber for increased performance. According to some embodiments, structures presently disclosed are fabricated with flexible materials to preserve surface conforming ability of porous absorbers.

According to some embodiments, structures presently disclosed may be used on wheel wells, inside doors, dashboards, and floor pans, under hoods, between fuselage panels, etc. According to some embodiments, structures presently disclosed may be used to form and/or be part of containment encasements placed over noisy equipment such as compressors, pumps, and/or transformers.

According to some embodiments, structures presently disclosed accelerate the fluid particle of acoustic waves to enhance dissipation by porous absorber materials.

According to some embodiments, structures presently disclosed are configured to increase significantly local fluid velocity, and therefore they enhance dissipation accordingly. As a consequence, thinner absorber layers can be used, or a given thickness of absorber can provide more sound dissipation.

Figure 2A:
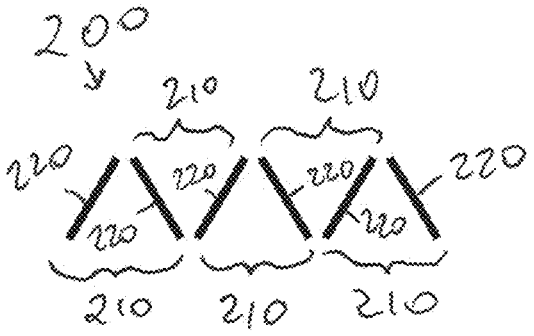
FIG. 2*a* depicts an embodiment according to the present disclosure.
Figure 2B:
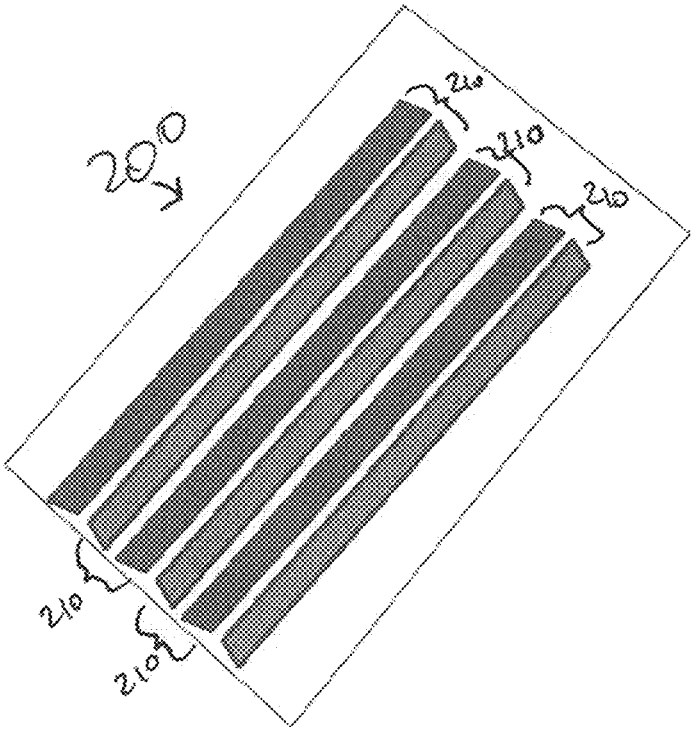
FIG. 2*b* depicts perspective view of the embodiment shown in FIG. 2*a*.
Figure 6A:
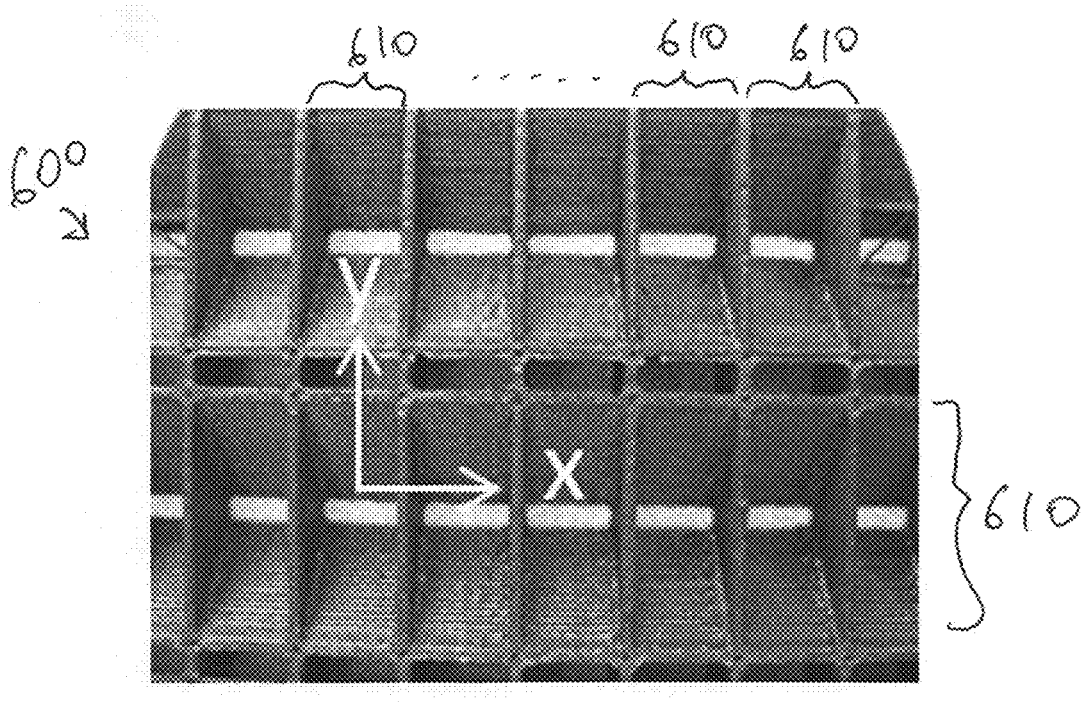
FIG. 6*a* depicts another embodiment according to the present disclosure.
Figure 6B:
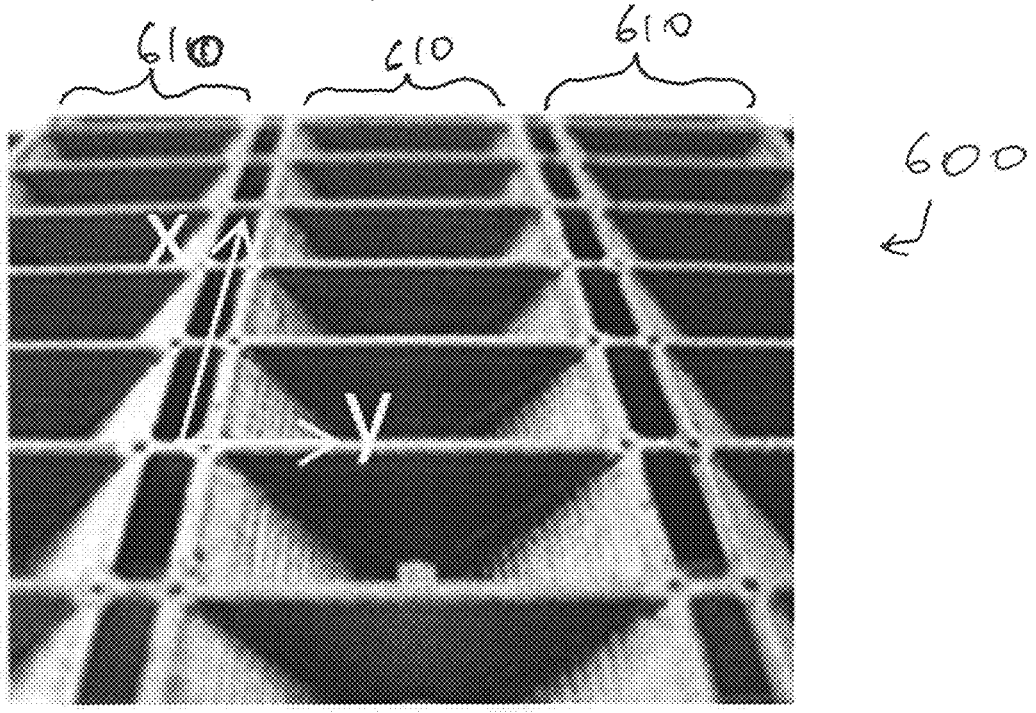
FIG. 6*b* depicts another embodiment according to the present disclosure.

FIG. 2*a* depicts a front view and FIG. 2*b* depicts a perspective view of an array 200 of structures 210 according to some embodiments presently disclosed. In some embodiments, the structures 210 comprise strips 220 arranged on a plane to form two-dimensional converging and diverging nozzles, with the strips 220 forming the nozzle walls secured to each other by thin rods or strips perpendicular to the plane (as shown in FIGS. 6*a*-*b*). According to some embodiments, the strips 220 are planar. According to some embodiments, two adjacent structure 210 share a common strip 220. According to some embodiments, two adjacent nozzles share a common strip 220.

Figure 3A:
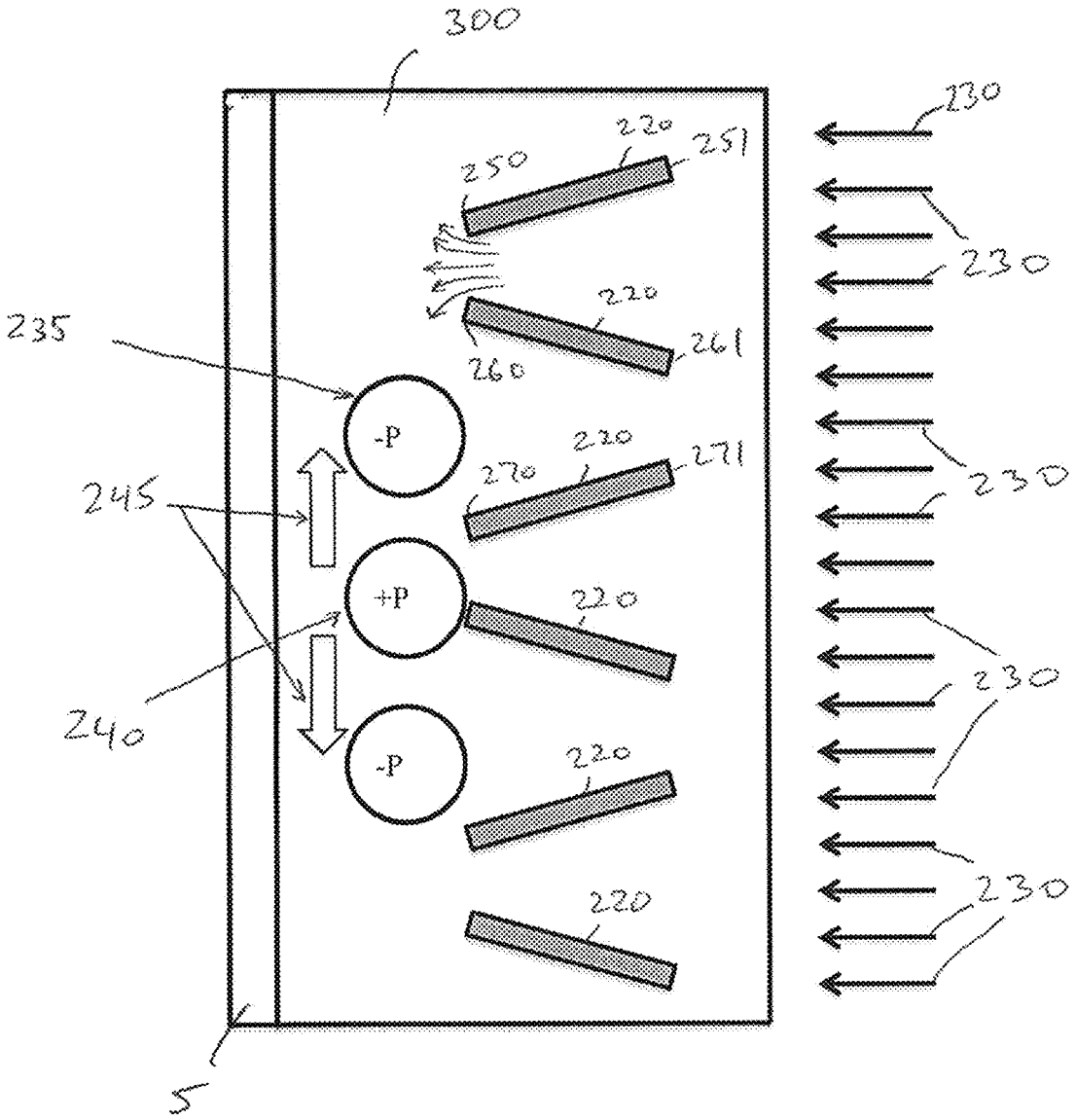
FIG. 3*a* depicts an embodiment according to the present disclosure.

According to some embodiments, the array 200 of the strips 220 is disposed on a surface of a porous absorber materials (not shown). According to some embodiments, the array 200 of the strips 220 is disposed within an absorber material 300 as shown in FIG. 3*a*. According to some embodiments, the absorber material 300 is porous. According to some embodiments, the absorber material 300 absorbs acoustic energy. According to some embodiments, the absorber material 300 is an acoustic energy absorber material. According to some embodiment, the array 200 of the strips 220 are disposed adjacent to a wall 5 as shown in FIG. 3*a*. According to some embodiments, the wall 5 comprises non-absorbent material.

Referring to FIG. 3*a*, according to some embodiments, the array 200 presently disclosed increases fluid movement in the low velocity region. As an acoustic wave (represented by lines 230) propagates through the array 200, pressure and velocity magnitude drop across diverging nozzles as shown by reference number 235 and they increase across converging nozzles as shown by reference number 240. According to some embodiments, the majority of the incident energy is captured by the converging nozzle formed by strips 220 to produce a high velocity jet at the exit, creating a large amount of dissipation. The diverging nozzles formed by the strips 220 on the other hand, produce a low pressure zone at the exit, which results in alternating high and low pressure zones at the exits of the converging and diverging nozzles, respectively, resulting in transverse fluid particle flow from the high pressure zones to the low pressure ones (as shown by reference number 245), as predicted by the acoustics momentum equation $\nabla p = i\omega\rho\vec{v}$. Thus, the jets at the exit of the converging nozzles include both forward and transverse components, leading to further dissipation efficiency. Furthermore, since fluid particles are rushing back and forth throughout each wave period, this fluid flow mechanism is duplicated on the other side of the array 200 during the second half of the wave cycle.

Webster's equation describes approximately an acoustic wave propagating through a variable cross-section duct:

$$\frac{\partial^2 p}{\partial x^2} + \left[\frac{A'(x)}{A(x)}\right]\frac{\partial p}{\partial x} = \frac{1}{c^2}\frac{\partial^2 p}{\partial t^2}$$

where A(x) is the cross section area as a function of axial distance x and c is the speed of sound. Webster's equation is discussed in more details by Allan D. Pierce in "Acoustics: An Introduction to its Physical Principles and Applications", which is incorporated herein in its entirety.

According to some embodiments, nozzles formed by strips 220 as presently disclosed comprise dimensions that are smaller than acoustic wavelengths therefore reflections at the ends of the nozzles can be neglected.

Referring to FIG. 3*a*, according to some embodiments, the first strip 220 comprises a first end 250 and a second end 251, the second strip 220 comprises a first end 260 and a second end 261, the third strip 220 comprises a first end 270 and a second end 271. According to some embodiments, a first distance between the first end 250 and the first end 260 is less than a second distance between the second end 251 and the second end 261. According to some embodiments, a third distance between the first end 260 and the first end 270 is greater than a fourth distance between the second end 261 and the second end 271.

Referring to FIG. 3*a*, according to some embodiments, the strips 220 are disposed within the absorber material 300. According to some embodiments, the absorber material 300 surrounds the strips 220.

Figure 3B:
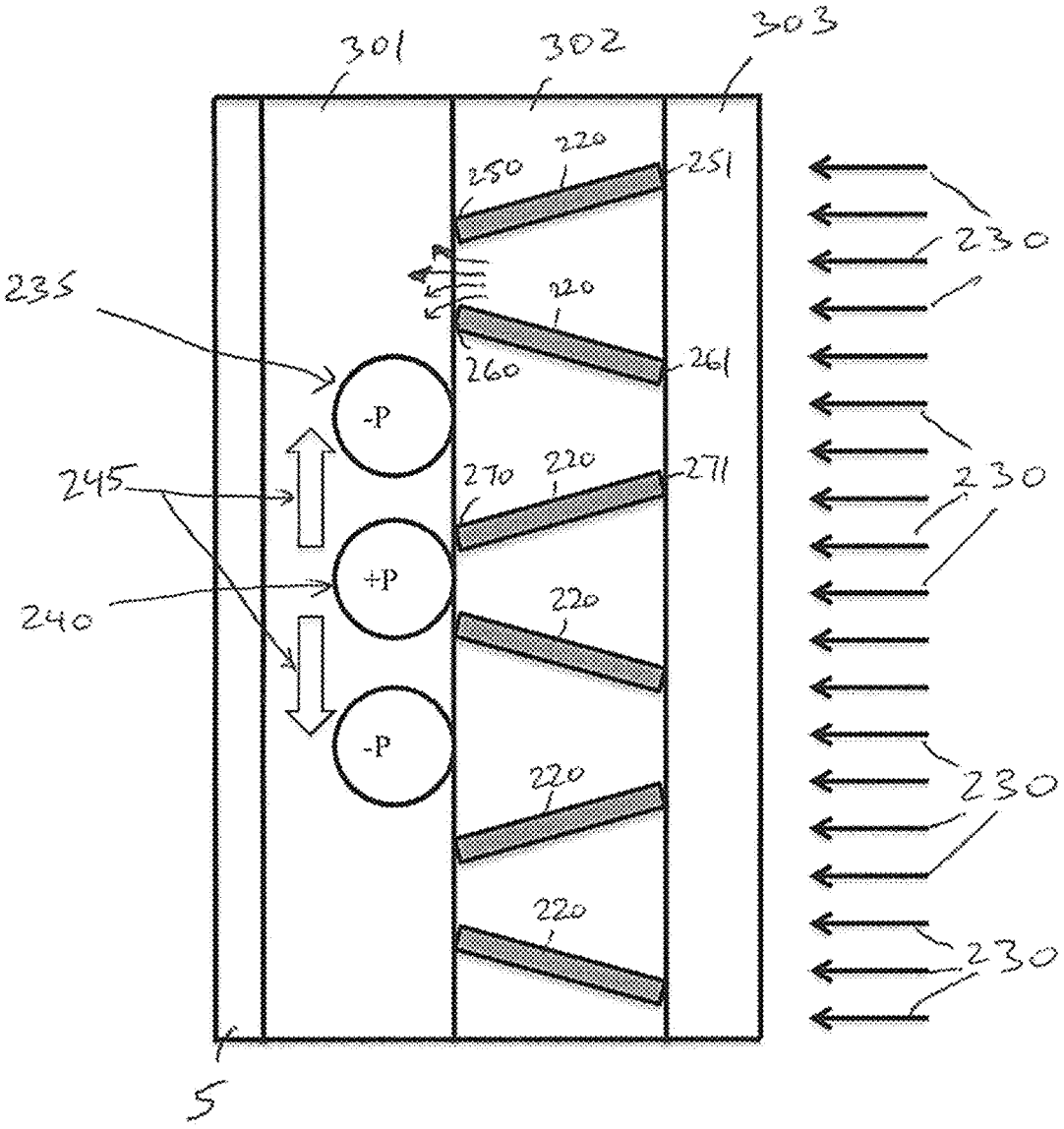
FIG. 3*b* depicts another embodiment according to the present disclosure.

Referring to FIG. 3*b*, a first absorber material 301 is disposed between the wall 5 and the strips 220. According to some embodiments, the first absorber material 301 is porous. According to some embodiments, the first absorber material 301 is positioned to absorb at least a portion of the acoustic wave (represented by lines 230) that comes out of the strips 220. According to some embodiments, the first absorber material 301 is positioned to absorb at least a portion of the energy that comes out of the strips 220. According to some embodiments, the first absorber material 301 absorbs acoustic energy. According to some embodiments, the first absorber material 301 is a first acoustic energy absorber material.

Referring to FIG. 3*b*, a second absorber material 302 is disposed between the strips 220. According to some embodiments, the second absorber material 302 is porous. According to some embodiments, the second absorber material 302 is positioned to absorb at least a portion of the acoustic wave (represented by lines 230) that is between the strips 220. According to some embodiments, the second absorber material 302 is positioned to absorb at least a portion of the energy that is between the strips 220. According to some embodiments, the second absorber material 302 absorbs acoustic energy. According to some embodiments, the second absorber material 302 is a second acoustic energy absorber material.

Referring to FIG. 3*b*, a third absorber material 303 is disposed between the incoming acoustic wave (represented by lines 230) and the strips 220. According to some embodiments, the third absorber material 303 is porous. According to some embodiments, the third absorber material 303 is positioned to absorb at least a portion of the acoustic wave (represented by lines 230) before it enters the strips 220. According to some embodiments, the third absorber material 303 is positioned to absorb at least a portion of the energy before it enters the strips 220. According to some embodiments, the third absorber material 303 absorbs acoustic energy. According to some embodiments, the third absorber material 303 is a third acoustic energy absorber material.

Figures 4A, 4B:
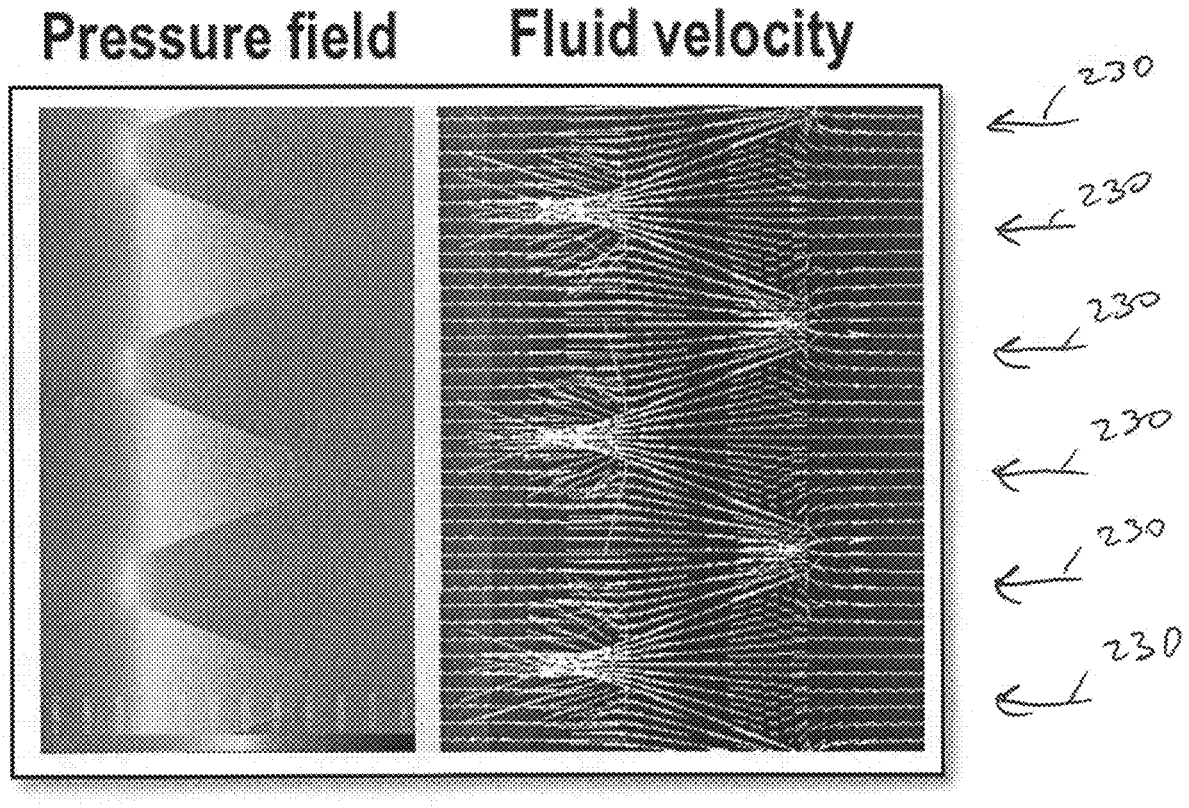
FIG. 4*a* depicts high pressure at a narrow end of a converging nozzles according to the present disclosure.
FIG. 4*b* depicts high fluid particle velocity jets at the exit of converging nozzles according to the present disclosure.

Various software simulations, including simulation done of Finite Elements software by COMSOL™ Inc, have confirmed the physical mechanisms described in the previous paragraphs. FIG. 4*a* depicts how pressure rises across converging nozzles formed by strips 220 and how pressure drops across diverging nozzles formed by the strips 220, whereas FIG. 4*b* depicts the resulting fluid particle jets.

Figure 5:
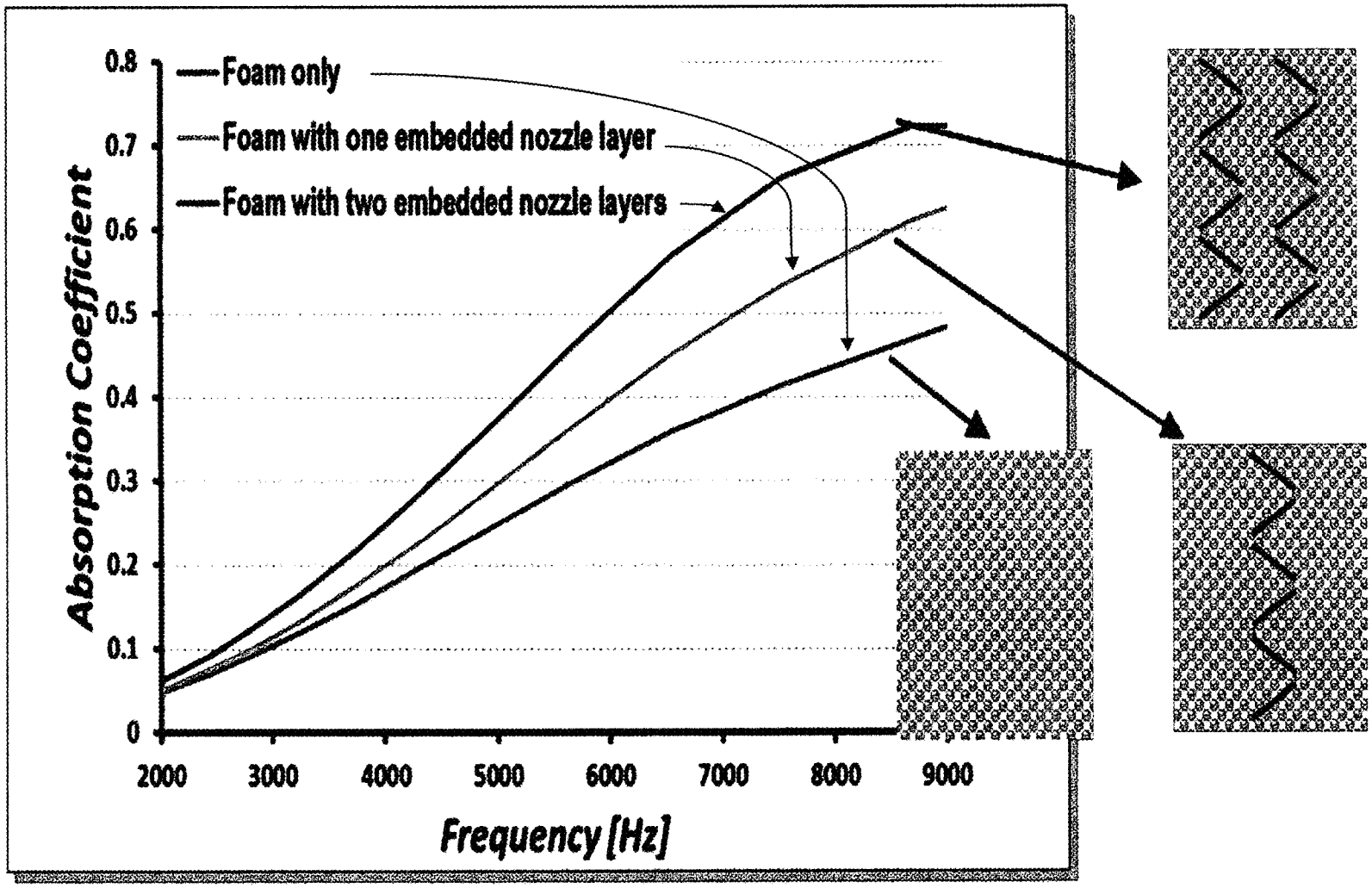
FIG. 5 depicts simulation results for embodiments presently disclosed.

Another set of simulation results depicted in FIG. 5 show that adding the array 200 to a layer of foam increases its sound absorption. Adding two layers of the array 200 increases absorption even more.

FIG. 6*a* depicts a top view and FIG. 6*b* depicts a perspective view of an array 600 of nozzle structures 610 according to some embodiments presently disclosed. According to some embodiments, the nozzle structures 610 comprise angled walls perpendicular to Y direction, which defines the nozzle structure 610 area change through the thickness. According to some embodiments, the nozzle structure 610 walls perpendicular to X direction are vertical and do not contribute the area change. In some embodiments, the area ratio between the inlets and exits of the nozzle structure 610 is about 9:1 and the thickness is 9 mm with 0.5 mm thick nozzle wall as shown in FIGS. 6*a-b*. According to some embodiments, the thickness of the structure in the Z-direction is 1-10 of a wavelength. According to some embodiments, the thickness of the structure in the Z-direction is 1/20 to 1/8 of a wavelength.

Figure 7:
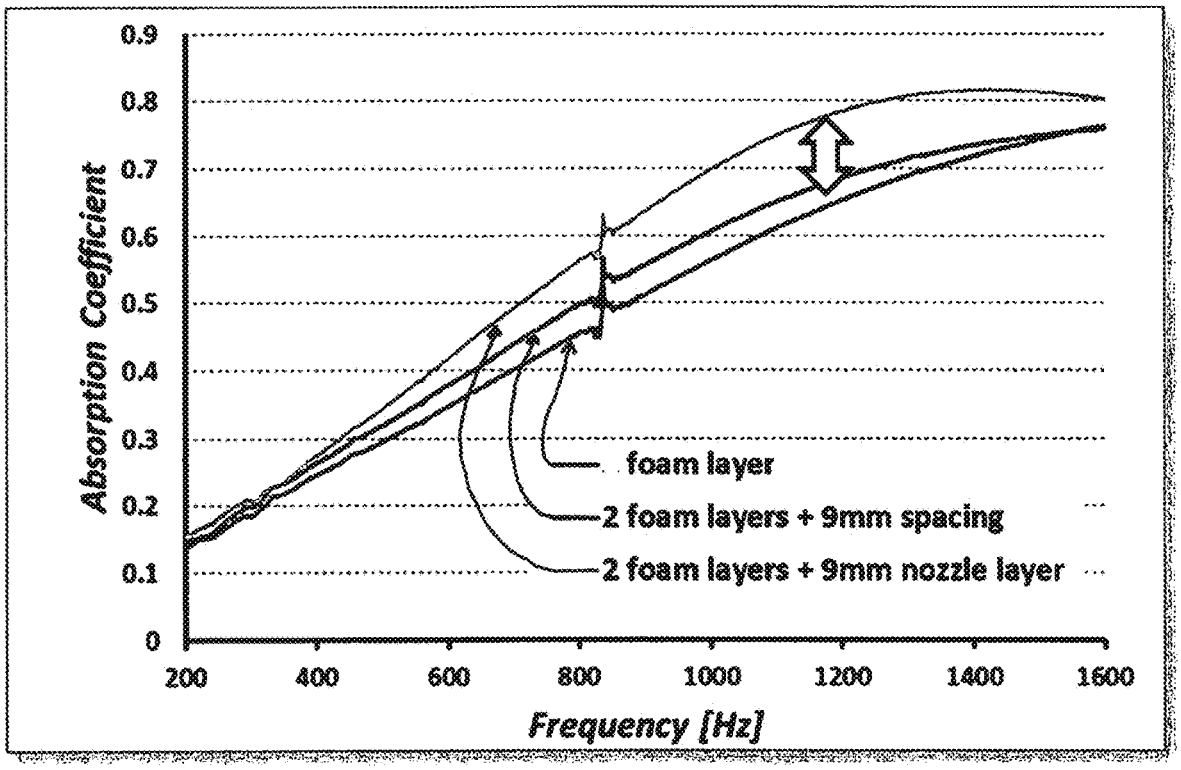
FIG. 7 depicts measurement results for one or more embodiments presently disclosed.

FIG. 7 depicts sound absorption coefficient measurements made for a layer of foam alone; two foam layers with an air gap between them; and two foam layers with the nozzle structure as disclosed presently between them. As supported by result shown in FIG. 7, embedding a nozzle structure as disclosed presently improves sound absorption over a wide range of frequencies.

Figure 8:
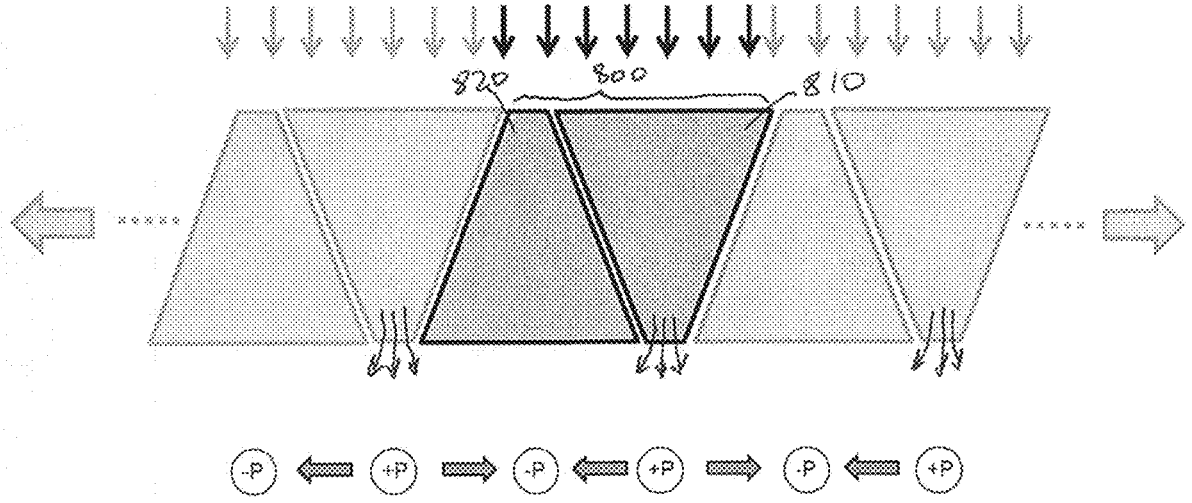
FIG. 8 depicts another embodiment according to the present disclosure.

According to some embodiments, a unit cell of a nozzle structure 800 according to the present disclosure is shown in FIG. 8. According to some embodiments, the unit cell of the nozzle structure 800 comprises a converging nozzle 810 and a diverging nozzle 820, as shown in FIG. 8. In some embodiments the converging nozzle 810 and the diverging nozzle 820 are sub-wavelength. In some embodiments the converging nozzle 810 and the diverging nozzle 820 are near-wavelength. According to some embodiments, the converging nozzle 810 and the diverging nozzle 820 are less than the conventional 1/4 wavelength.

Referring to FIG. 8, the arrows above the structure 800 indicate the incident wave and the arrows below the structure 800 illustrate the fluid jets at the exits of the converging nozzles 810. The +P symbol indicates pressure peaks at the exits of converging nozzle 810 and −P symbol indicate pressure valleys at the exits of diverging nozzle 820, to induce lateral fluid particle flow.

Figure 9:
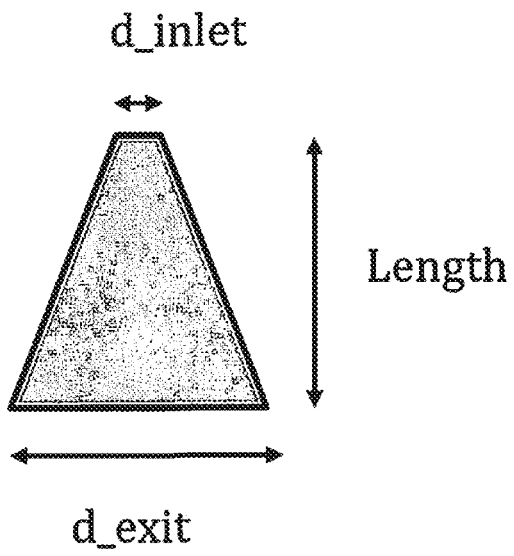
FIG. 9 depicts dimensional parameters of an embodiment according to the present disclosure.

As can be appreciated by one skilled in the art, the dimensions of the nozzles 810, 820 can be optimized for particular applications or to conform to various constraints. Inlet area, exit area, and length are parameters available for design fine-tuning, as shown in FIG. 9.

Figures 10A, 10B, 10C:
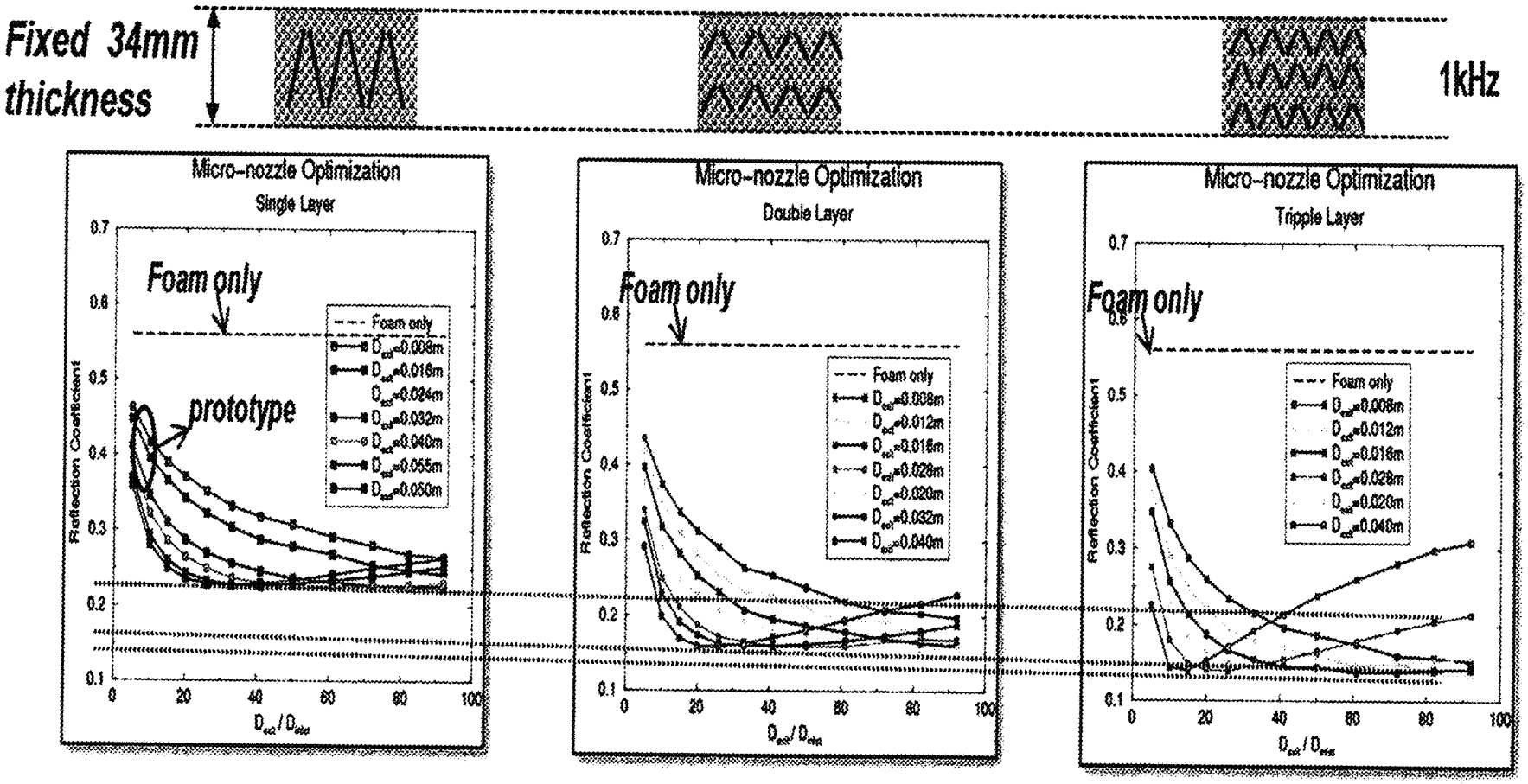
FIG. 10*a-c* depict simulation results for embodiments presently disclosed.

FIGS. 10*a-c* depict various simulation results for structures presently disclosed. FIG. 10*a* depicts simulation results of a single layer structure embedded within a fixed thickness of foam of thickness of about 34 mm according to the present disclosure. FIG. 10*b* depicts simulation results of a double layer structure embedded within a fixed thickness of foam of thickness of about 34 mm according to the present disclosure. FIG. 10*c* depicts simulation results of a triple layer structure embedded within a fixed thickness of foam of thickness of about 34 mm according to the present disclosure. Referring to FIGS. 10*a-c*, for a set of d_exit values, d inlet has been swept over a range of values generating a reflection coefficient curve for each d_exit value. Simulations results in FIG. 10*a-c* show that the reflection coefficient can be reduced significantly. Simulations results in FIG. 10*a-c* show that embedding more layer structures improves performance. A target frequency of 1 kHz was used to obtain results shown in FIGS. 10*a-c*. According to some embodiments, d_exit ranges from 0.008 to 0.4. According to some embodiments, the ratio ranges from 5:1 to 90:1.

Figure 11A:
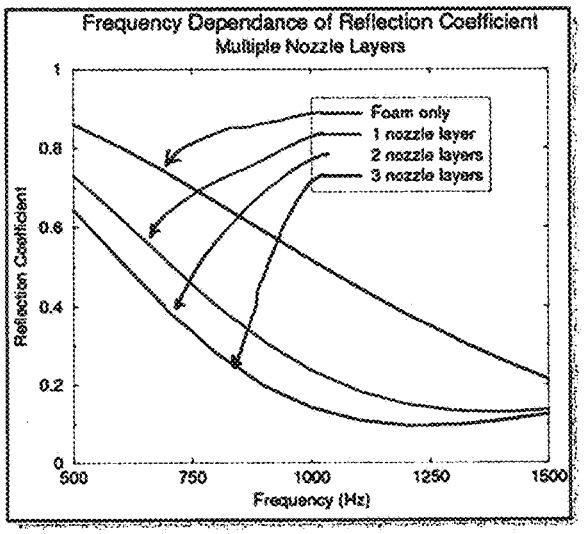
FIG. 11*a-b* depict simulation results for embodiments presently disclosed.

FIG. 11*a* depicts reflection coefficient computed as a function of frequency for structures simulated in FIGS.

Figure 11B:
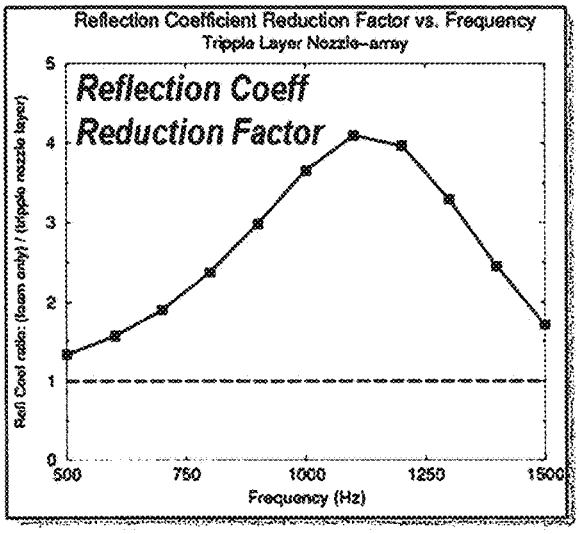

10*a-c*. The results depicted in FIG. 11*a* demonstrate significant reduction in the reflection coefficient over a wide frequency range compared to using bare foam only without embedded nozzle structures according to the present disclosure. For the triple nozzle layer design, a peak reflection coefficient reduction factor of four was achieved, as shown in FIG. 11*b*.

Figure 12:
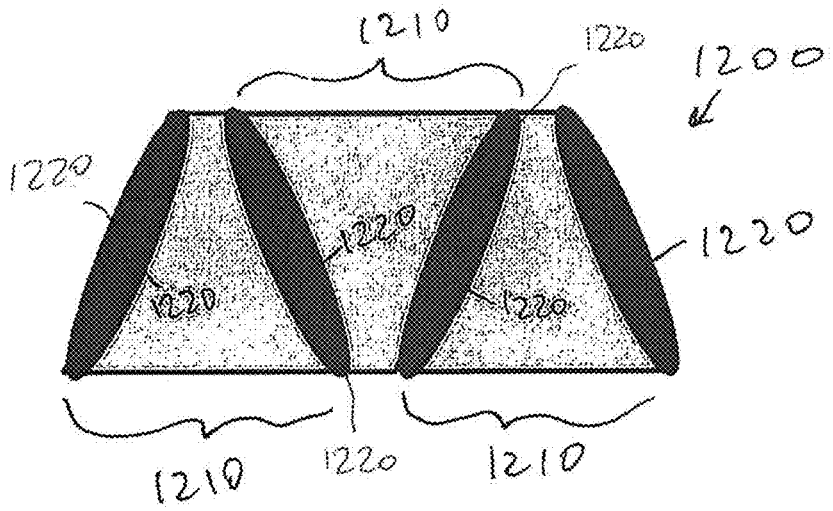
FIG. 12 depicts another embodiment according to the present disclosure.

FIG. 12 depicts an array 1200 of structures 1210 according to some embodiments presently disclosed. In some embodiments, the structures 1210 comprise walls 1220 arranged on a plane to form two-dimensional converging and diverging nozzles, with the walls 1220 forming the nozzle walls secured to each other by, for example, thin rods (not shown) or strips perpendicular to the plane (not shown). According to some embodiments, the walls 1220 may be formed as strips. In some embodiments, the walls 1220 comprise a geometrical shape. In some embodiments, the walls 1220 comprise semi-circular, oval, non-linear shape. According to some embodiments, the nozzles defined by the walls 1220 may have curved, round, or elliptical shapes. In some embodiments, the walls 1220 comprise semi-circular, oval, non-linear cross-shape. According to some embodiments, two adjacent structure 1210 share a common wall 1220. According to some embodiments, two adjacent nozzles share a common wall 1220.

Figure 13:
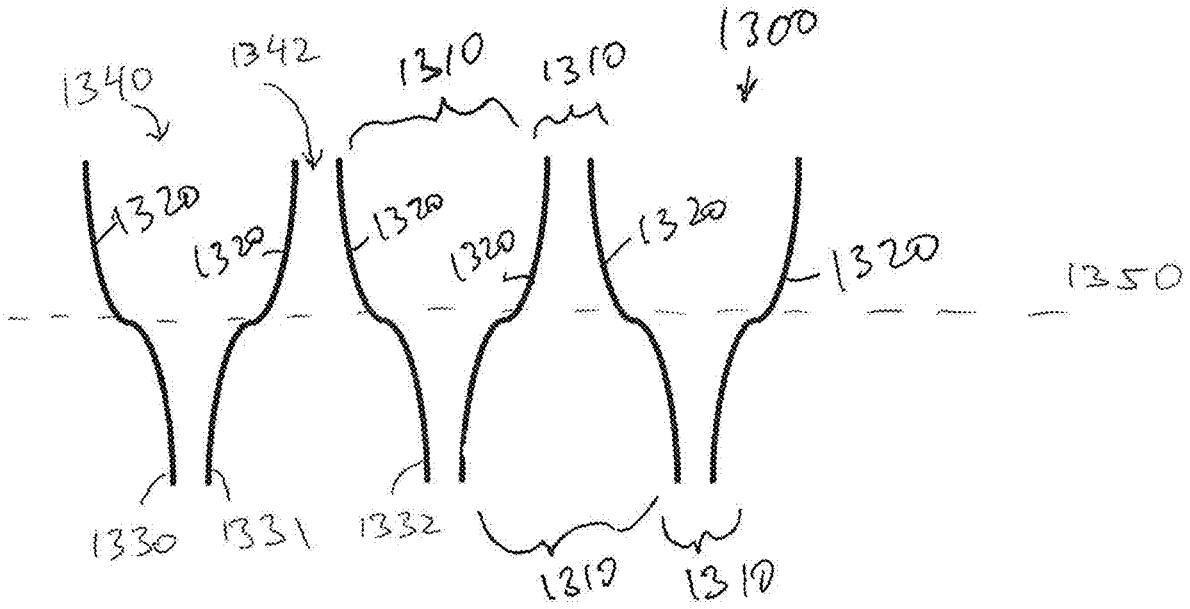
FIG. 13 depicts another embodiment according to the present disclosure.

FIG. 13 depicts an array 1300 of structures 1310 according to some embodiments presently disclosed. In some embodiments, the structures 1310 comprise walls 1320 arranged on a plane to form two-dimensional converging and diverging nozzles, with the walls 1320 forming the nozzle walls secured to each other by, for example, thin rods (not shown) or strips perpendicular to the plane (not shown). In some embodiments, the walls 1320 comprise a non-linear shape. In some embodiments, the cross-section of the walls 1320 comprise shape with one or more curves. In some embodiments, the walls 1320 comprise shapes with two or more curves.

As shown in FIG. 13, according to some embodiments, the walls 1330, 1331 for a first nozzle 1340 curve inward towards a center axis (represented by a dotted line 1350) at one end to define a wide opening and curve outward at the opposite end to define a narrow opening of the first nozzle 1340. According to some embodiments, the walls 1331, 1332 for a second nozzle 1342 curve inward towards a center axis (represented by a dotted line 1350) at one end to define a wide opening and curve outward at the opposite end to define a narrow opening of the second nozzle 1342. According to some embodiments, one or more adjacent nozzles are oriented in the opposite direction. According to some embodiments, the narrow opening of the second nozzle 1342 is disposed next to a wide opening of the first nozzle 1340. According to some embodiments, two adjacent structure 1310 share a common wall 1320. According to some embodiments, two adjacent nozzles 1340, 13425 share a common wall 1331.

Figure 14:
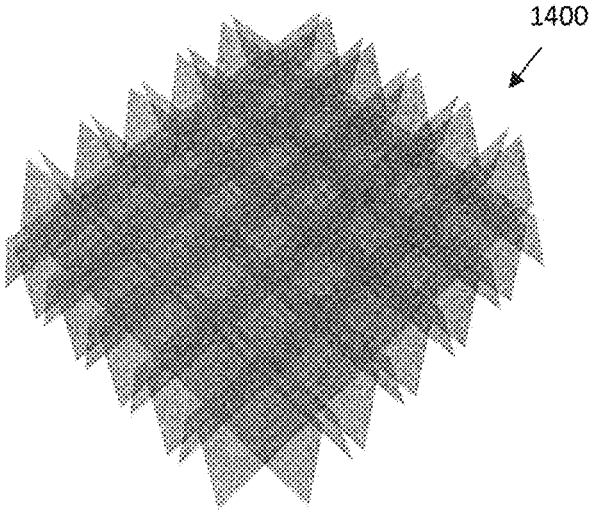
FIG. 14 depicts another embodiment according to the present disclosure.

FIG. 14 depicts an array 1400 according to the present disclosure that is three-dimensional in nature. According to some embodiment, the array 1400 is configured by intersecting the array 200 shown in FIGS. 2*a-b* with its 90-degree rotated version. According to some embodiments, a wider rectangular or square opening of a nozzle may be bordered on four sides by smaller rectangular openings of oppositely oriented nozzles. Other shaped openings and configurations may be achieved by intersecting the array 200 with one or more rotated versions that are rotated at different angles, such as 30, 45, or 75 degrees.

Figure 15A:
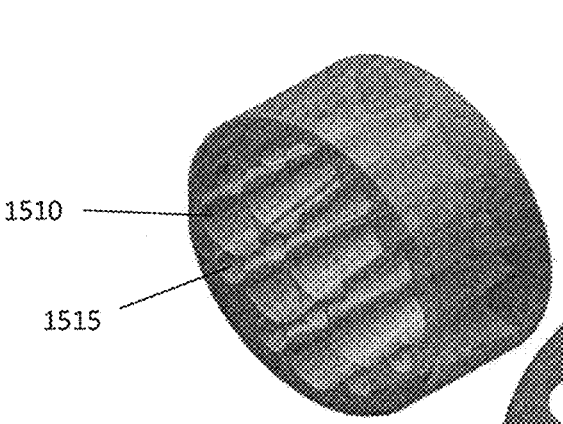
FIG. 15*a-b* depict another embodiment according to the present disclosure.
Figure 15B:
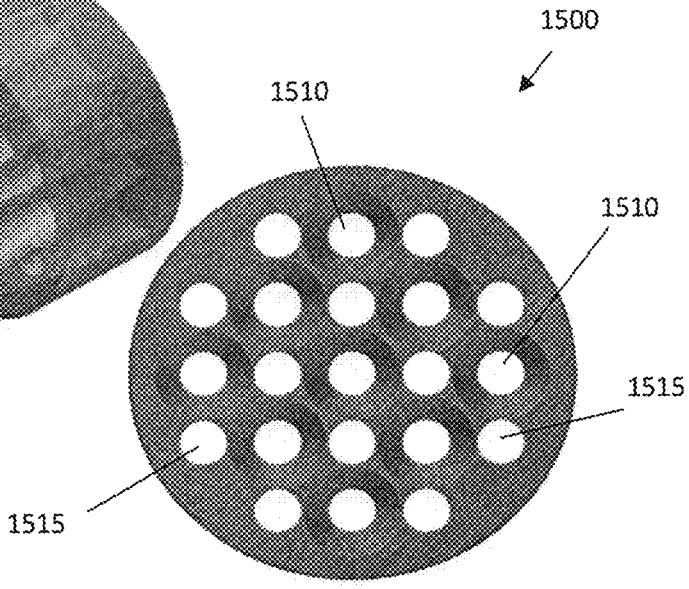

FIGS. 15*a-b* depict another array 1500 according to the present disclosure. According to some embodiments, the array 1500 comprises one or more passages 1510, 1515. According to some embodiments, the passages 1510 are conical shape. According to some embodiments, openings at the ends of the conical passages 1510 are circular, triangular, square, hexagonal or a combination of these shapes. According to some embodiments, the passages 1510 vary in diameter between larger and smaller along the length of the passage 1510.

As shown in FIGS. 15*a-b*, according to some embodiments, one or more adjacent passages 1510, 1515 are oriented in the opposite direction. According to some embodiments, the narrow opening of the passage 1515 is disposed next to a wide opening of the passage 1510.

Figure 16A:
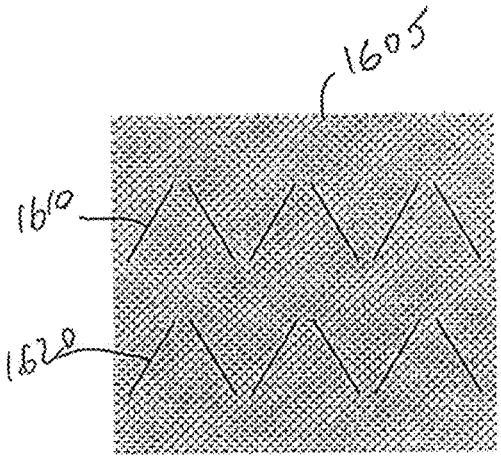
FIG. 16*a* depicts another embodiment according to the present disclosure.
Figure 16B:
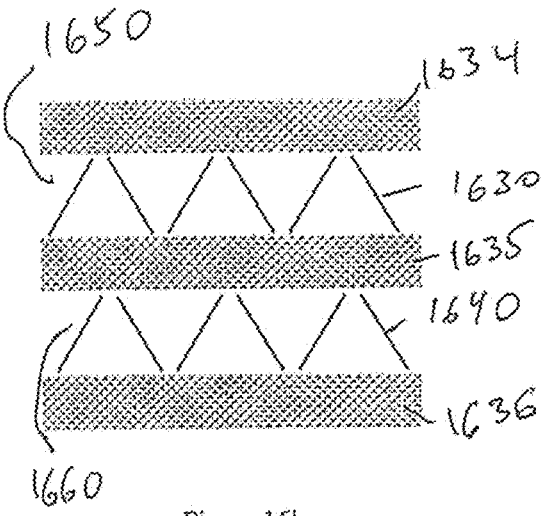
FIG. 16*b* depicts another embodiment according to the present disclosure.

According to some embodiments, structures 1610 and 1620 presently disclosed are stacked on top of each other within an absorbing material 1605 without an air gap as shown in FIG. 16*a*. According to some embodiments, structures 1630 and 1640 presently disclosed are stacked on top of each other and separated by a layer of absorbing material 1635 with one or more air gaps 1650, 1660 as shown in FIG. 16*b*. According to some embodiments, the air gaps are composed of air filled volumes within the nozzles of FIG. 16*b*. According to some embodiments, structures 1630 are disposed between a layer of absorbing material 1634 and the layer of absorbing material 1635. According to some embodiments, structures 1640 are disposed between a layer of absorbing material 1636 and the layer of absorbing material 1635.

Figure 17:
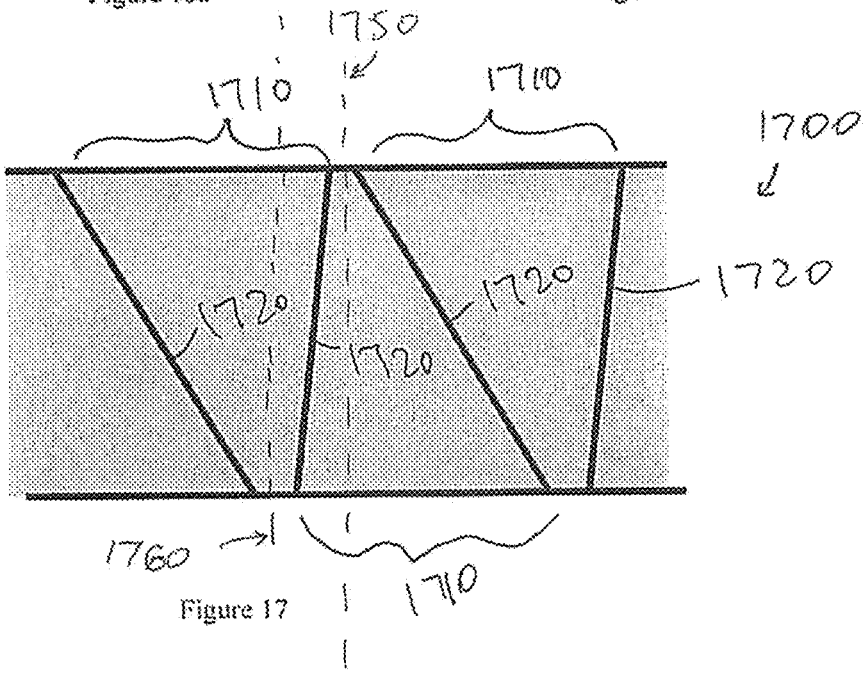
FIG. 17 depicts another embodiment according to the present disclosure.

FIG. 17 depicts an array 1700 of structures 1710 according to some embodiments presently disclosed. In some embodiments, the structures 1710 comprise strips 1720 arranged on a plane to form two-dimensional converging and diverging nozzles, with the strips 1720 forming the nozzle walls secured to each other by, for example, thin rods (not shown) or strips perpendicular to the plane (not shown). In some embodiments, the structures 1710 are not symmetric about their axis as shown in FIG. 17. In some embodiments, the structures 1710 are not symmetric about an axis (represented by dashed lines 1750, 1760) that extends between center points of two ends of an opening as shown in FIG. 17. These embodiments may accommodate a design variation that might beneficial when sound impinges on the array 1700 at oblique angles. According to some embodiments, two adjacent structure 1710 share a common strip 1720. According to some embodiments, two adjacent nozzles share a common strip 1720.

Figure 18:
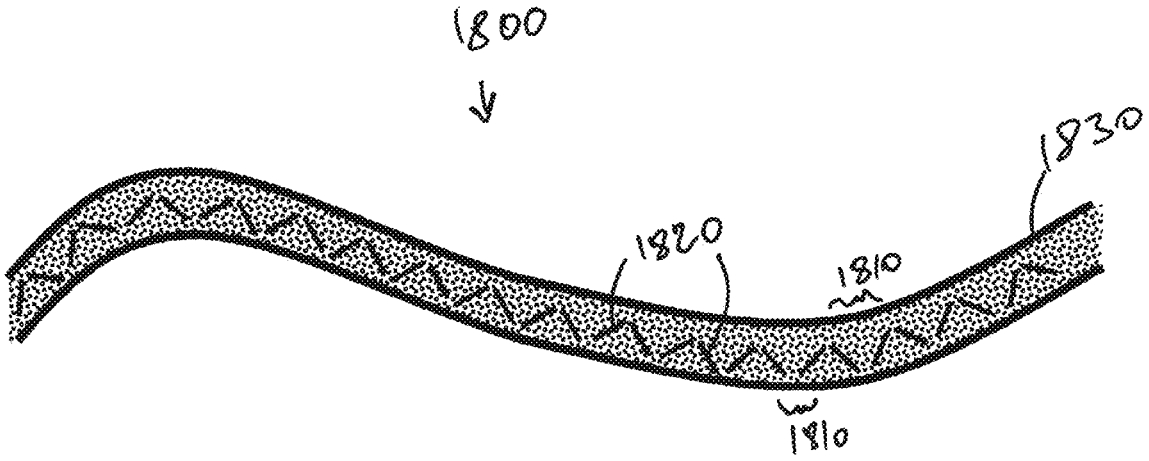
FIG. 18 depicts another embodiment according to the present disclosure.

FIG. 18 depicts an array 1800 of structures 1810 according to some embodiments presently disclosed. In some embodiments, the structures 1810 comprise strips 1820 arranged to form converging and diverging nozzles, with the strips 1820 forming the nozzle walls secured to each other by, for example, thin rods (not shown) or strips perpendicular to the plane (not shown). According to some embodiments, the array 1800 is partially or completely formed out of flexible material to be embedded inside conformal blankets 1830 designed for applications on curved surfaces, as shown in FIG. 18. According to some embodiments, the array 1800 is formed from rigid materials on a curved surface.

It should be clear to one skilled in the art that all design variations of nozzle structure described above can be exploited/mixed together to optimize and fine-tune absorption performance. It is also to be understood that the converging and diverging nozzles presently disclosed need not be in the same plane or of the same size.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . ."

What is claimed is:

1. An acoustic absorber comprising:

a plurality of adjacent passages defined by walls configured to generate alternating high and low pressure zones as an acoustic energy travels though the acoustic absorber, wherein a cross-sectional size of a first passage of the plurality of adjacent passages increases in a first direction, and wherein a cross-sectional size of a second passage of the plurality of adjacent passages adjacent to the first passage decreases in the first direction.

2. The acoustic absorber of claim 1, wherein the plurality of adjacent passages are defined by walls shaped as strips.

3. The acoustic absorber of claim 2, wherein the walls shaped as strips comprise:

a first strip comprising a first end and a second end;

a second strip comprising a first end and a second end; and a third strip comprising a first end and a second end;

wherein the first end of the first strip is disposed a first distance from the first end of the second strip;

wherein the second end of the first strip is disposed a second distance from the second end of the second strip;

wherein the first distance is less than the second distance;

wherein the first end of the second strip is disposed a third distance from the first end of the third strip;

wherein the second end of the second strip is disposed a fourth distance from the second end of the third strip; and wherein the third distance is greater than the fourth distance.

4. The acoustic absorber of claim 2, wherein the strips are disposed within a material able to at least partially absorb the acoustic energy.

5. The acoustic absorber of claim 4, wherein the material is porous.

6. The acoustic absorber of claim 2, wherein the strips are sandwiched between two layers of material able to at least partially absorb the acoustic energy.

7. The acoustic absorber of claim 6, wherein the material is porous.

8. The acoustic absorber of claim 3, wherein the first strip and second strip are configured to decrease pressure and velocity of the acoustic energy and wherein the second strip and the third strip are configured to increase the pressure and the velocity of the acoustic energy.

9. The acoustic absorber of claim 1, wherein the acoustic absorber is rigid.

10. The acoustic absorber of claim 1, wherein the acoustic absorber is flexible.

11. The acoustic absorber of claim 2, wherein the walls are curved.

12. The acoustic absorber of claim 1, wherein the plurality of adjacent passages form a first layer.

13. The acoustic absorber of claim 12 further comprising a second layer comprising another plurality of adjacent passages defined by walls configured to generate alternating high and low pressure zones as an acoustic energy travels though the acoustic absorber.

14. The acoustic absorber of claim 13 wherein the first layer and the second layer are disposed within a material able to at least partially absorb the acoustic energy.

15. The acoustic absorber of claim 14, wherein the material is porous.

16. The acoustic absorber of claim 14 further comprising a material between the first layer and the second layer, wherein the material is able to at least partially absorb the acoustic energy.

17. The acoustic absorber of claim 1, further comprising a first acoustic energy absorber material to at least partially absorb the acoustic energy exiting the acoustic absorber.

18. The acoustic absorber of claim 17, further comprising a second acoustic energy absorber material to at least partially absorb the acoustic energy within the acoustic absorber.

19. The acoustic absorber of claim 18, further comprising a third acoustic energy absorber material to at least partially absorb the acoustic energy before it enters the acoustic absorber.

20. An acoustic absorber comprising:

a plurality of conically shaped through holes configured to generate alternating high and low pressure zones as an acoustic wave travels though the acoustic absorber, wherein a cross-sectional size of a first conically shaped through hole of the plurality of conically shaped through holes increases in a first direction, and wherein a cross-sectional size of a second conically shaped through hole of the plurality of conically shaped through holes adjacent to the first conically shaped through hole decreases in the first direction.

21. A method of forming an acoustic absorber, comprising:

forming a plurality of adjacent passages defined by walls, each adjacent passage having a wider end and a narrower end, the adjacent passages being arranged to dispose a wider end of each adjacent passage adjacent to a narrower end of an adjacent passage;

wherein the adjacent passages are configured to generate alternating high and low pressure zones as an acoustic energy travels though the acoustic absorber, wherein a cross-sectional size of a first passage of the plurality of adjacent passages increases in a first direction, and wherein a cross-sectional size of a second passage of the plurality of adjacent passages adjacent to the first passage decreases in the first direction.

22. The method of claim 21, further comprising:

disposing a first acoustic energy absorber material to at least partially absorb the acoustic energy exiting the acoustic absorber.

23. The method of claim 22, further comprising:

disposing a second acoustic energy absorber material to at least partially absorb the acoustic energy within the acoustic absorber.

24. The method of claim 23, further comprising:

disposing a third acoustic energy absorber material to at least partially absorb the acoustic energy before it enters the acoustic absorber.

* * * * *